US006415532B1

(12) United States Patent
Bricko et al.

(10) Patent No.: US 6,415,532 B1
(45) Date of Patent: Jul. 9, 2002

(54) DRIVE SPROCKET FOR A ROLLER CHAIN FOR MATERIAL REMOVAL IMPLEMENT

(75) Inventors: Thomas K. Bricko, Lakeville; David A. Murray, Eagan, both of MN (US)

(73) Assignee: The Toro Company, Minneapolis, MN (US)

( * ) Notice: Subject to any disclaimer, the term of this patent is extended or adjusted under 35 U.S.C. 154(b) by 0 days.

(21) Appl. No.: 09/628,372

(22) Filed: Jul. 31, 2000

(51) Int. Cl.[7] ..... E02F 9/20
(52) U.S. Cl. ..... 37/361; 37/352
(58) Field of Search ..... 37/464, 462, 332, 37/352, 361, 362; 474/152, 155, 72; 30/383; 83/830

(56) References Cited

U.S. PATENT DOCUMENTS

| | | | | |
|---|---|---|---|---|
| 3,603,010 | A | * | 9/1971 | Polinek |
| 3,968,995 | A | | 7/1976 | Arentzen |
| 4,000,568 | A | * | 1/1977 | Donkers |
| 4,530,679 | A | | 7/1985 | Reynolds |
| 4,738,653 | A | * | 4/1988 | Riewerts et al. |
| 4,889,521 | A | | 12/1989 | Nagano |
| 4,950,211 | A | * | 8/1990 | James |
| 5,021,033 | A | | 6/1991 | Sundstrom |
| 5,318,483 | A | * | 6/1994 | Reid et al. |
| 5,876,295 | A | | 3/1999 | Young |
| 5,921,877 | A | | 7/1999 | Suzuki |
| 5,974,673 | A | | 11/1999 | Sundstrom |
| 5,976,045 | A | | 11/1999 | Young |
| 5,984,817 | A | | 11/1999 | Schulz |
| 6,013,001 | A | | 1/2000 | Miyoshi |

FOREIGN PATENT DOCUMENTS

DE 37 10983 A1 * 10/1988

* cited by examiner

*Primary Examiner*—Thomas B. Will
*Assistant Examiner*—Meredith C. Petravick
(74) *Attorney, Agent, or Firm*—James W. Miller

(57) ABSTRACT

A sprocket is disclosed for driving a chain with a plurality of chain rollers. The sprocket may be used to drive a material removal chain of a trencher. The sprocket has various cut-aways or reliefs on each face thereof to more effectively clear particulate debris from beneath chain rollers during cutting or digging operations. The sprocket also has asymmetrical teeth designed to help minimize changes in pitch diameter due to debris entrained beneath chain rollers. Reducing changes in pitch diameter greatly reduces premature wear of the sprocket and its chain. Reducing changes in pitch diameter also greatly reduces the tendency for the chain to bind.

22 Claims, 5 Drawing Sheets

DRIVE SPROCKET FOR A ROLLER CHAIN FOR MATERIAL REMOVAL IMPLEMENT

TECHNICAL FIELD

This invention relates to a sprocket for a roller chain, particularly for a roller chain used in an implement to cut, dig, or otherwise remove material. In its preferred embodiment, the sprocket drives a trencher roller chain.

BACKGROUND OF THE INVENTION

Chainsaws, mining machines, trenchers, and the like use a roller chain to cut, dig or remove material. The chain, which typically carries a series of cutting blades or bits, is entrained around at least one drive sprocket and one idler sprocket. The drive sprocket supports one end of the chain and is coupled to a motor or some other power source to drive the chain. An idler sprocket supports the other end of the chain. If the chain is long, additional idler sprockets may optionally be used at various locations between the ends of the chain.

Various trenchers are known which use the sprocket and chain arrangement described above to dig trenches. These trenches are usually between 2 and 6 feet deep and many yards long. A trench is often dug in order to bury cables or a pipeline. The sprocket and chain arrangement described above allows several cutting passes of the blades or bits attached to the chain within a short amount of time and further facilitates the removal of dirt from the trench.

In many cutting or digging applications, the chain and its supporting sprockets are in constant contact with particulate debris. For example, in the case of a trencher, this particulate debris typically comprises dirt, rocks, and/or sand dug up by the trenching operation. In the case of a chainsaw, the particulate debris typically comprises wood chips and/or sawdust generated by the operation of the chainsaw. In any event, regardless of whether the tool comprises a trencher or a chainsaw, the particulate debris described above frequently gets under the chain rollers between the chain rollers and various surfaces of the sprockets. Since much of this particulate debris is abrasive, this can relatively quickly wear down the sprocket and chain, thereby requiring more frequent replacement of these components than is desirable.

In addition, the particulate debris described above can quickly build up in a layer or coating between the chain rollers and the sprocket. This build up has the effect of increasing the pitch diameter of the sprocket, meaning the chain rollers are forced to ride the sprocket on a larger diameter than normal. The increase in pitch diameter requires the chain to stretch or elongate, which also wears the chain out prematurely.

Moreover, if the pitch diameter increases too much, the chain cannot stretch anymore and it binds. When the chain used on a trencher binds, the trencher chain will not run in the forward digging direction. The operator must then run the trencher chain in reverse to clear the particulate debris buildup.

Several proposals have previously addressed the problem of clearing debris from sprocket and chain areas to prevent premature chain wear and binding. One prior art concept addressing the chain binding problem is that of a variable length chain bar. The chain bar is the support structure the chain travels around. The drive and idler sprockets are located at opposite ends of the chain bar to facilitate motion of the chain. In a variable length chain bar, the chain bar is spring loaded in compression along its lengthwise axis.

When dirt or other debris builds up on the sprocket, the pitch diameter increases and the distance the chain must now travel around the chain bar increases. This results in increasing tension in the chain with the chain potentially binding. However, in a variable length chain bar, the increasing tension in the chain causes the chain bar to shorten. The shortening of the chain bar offsets the extra distance caused by the increase in pitch diameter and relieves the increasing tension in the chain.

While a variable length chain bar postpones chain binding, at some point the chain bar cannot shorten further. In this situation, as dirt and debris continue to build up on the sprocket, the fully shortened chain bar now acts as a rigid chain bar. Consequently, after the chain bar reaches its minimum length, the chain will still bind if dirt and debris continue to build up on the sprocket.

other proposals have focused on the sprocket design. U.S. Pat. No. 3,968,995 to Arentzen shows a roller chain sprocket having dirt gashes or reliefs cut on either face of the sprocket adjacent the bottom of the gullet that receives the chain roller. Each dirt gash or relief extends radially inwardly from the gullet towards the center of the sprocket and is inclined outwardly towards an adjacent face of the sprocket. The purpose of such dirt gash or relief is to "promote discharge of dirt from between the rollers and sprocket teeth." However, the gullet itself is designed so that the chain rollers engage against the bottom diameter surface of the gullet.

While the use of the dirt gashes or reliefs in the Arentzen patent may be helpful in keeping particulate debris from building up between the chain rollers and the sprockets, it is not completely satisfactory. For example, in a trencher, the volume of debris may be so great that there is insufficient space beneath the chain rollers when the rollers are received in the gullets to accommodate this volume. Thus, debris may still build up beneath the chain rollers despite the presence of the dirt gashes or reliefs.

In addition, particulate debris may also build up on the "flanks" of a sprocket tooth between the tooth flanks and the front and back sides of the chain rollers. The dirt gashes or reliefs disclosed in Arentzen are not positioned to promote the discharge of this debris. In other words, any debris that becomes trapped between the front and back sides of the chain rollers and the flanks of the sprocket teeth never reach the dirt gashes or reliefs provided on the sprocket in the Arentzen patent.

In addition, standard sprockets used with roller chains typically have a symmetrical tooth form. Some sprockets for roller chains, such as those shown in U.S. Pat. Nos. 5,876,295 and 5,976,045, have asymmetrical tooth profiles. These asymmetrical tooth profiles are thought to reduce noise in certain roller chain applications such as in automotive engine applications. In these applications, a noisy chain drive would be a problem since it might be heard by the driver or passengers of the vehicle.

However, chain noise is not generally a concern for users of cutting or digging tools, like chainsaws or trenchers, due to the noise generated by the blades or bits during the cutting or digging operation. Accordingly, the sprockets used to drive such chains have typically been sprockets with symmetrically shaped teeth.

SUMMARY OF THE INVENTION

One aspect of this invention relates to a material removal implement and a sprocket therefor. The implement comprises a roller chain having a plurality of chain rollers. The roller chain carries a plurality of cutter blades or bits that remove material as the roller chain is driven. A drive sprocket and at least one idler sprocket are provided around which the roller chain is entrained. The drive and idler sprockets each have a plurality of radially outwardly extending teeth that engage against the chain rollers of the chain. A drive system is coupled to the drive sprocket for rotating the drive sprocket in a forward direction to thereby drive the roller chain in a forward direction in which the cutter blades or bits remove material. The drive sprocket has asymmetrically shaped teeth with each tooth having a leading flank and a trailing flank taken with respect to the forward direction of rotation of the drive sprocket. The trailing flank has a larger angle with respect to a radial line extending from a center of the drive sprocket through an apex of the trailing flank than the angle formed between the leading flank and a radial line extending from a center of the drive sprocket through an apex of the leading flank.

Another aspect of this invention relates to a material removal implement and a sprocket therefor. The implement comprises a roller chain having a plurality of chain rollers. The roller chain carries a plurality of cutter blades or bits that remove material as the roller chain is driven. A drive sprocket and at least one idler sprocket are provided around which the roller chain is entrained. The drive and idler sprockets each have a plurality of radially outwardly extending teeth that engage against the chain rollers of the chain. A plurality of gullets are formed between adjacent chain rollers of the chain. A drive system is coupled to the drive sprocket for rotating the drive sprocket in a forward direction to thereby drive the roller chain in a forward direction in which the cutter blades or bits remove material. At least the one drive sprocket further comprises a gap between the bottom of the gullet and the chain roller when the chain roller is in fully engaged contact with the gullet. In addition, the drive sprocket further comprises a pair of first cut-aways. One first cut-away is provided on each face of the drive sprocket extending radially inwardly from the gap and laterally outwardly towards the face of the drive sprocket. The two first cut-aways collectively communicate with the gap to guide particulate debris collecting in the gap to either side of the drive sprocket.

Yet another aspect of this invention relates to a material removal implement and a sprocket therefor. The implement comprises a roller chain having a plurality of chain rollers. The roller chain carries a plurality of cutter blades or bits that remove material as the roller chain is driven. A drive sprocket and at least one idler sprocket are provided around which the roller chain is entrained. The drive and idler sprockets each have a plurality of radially outwardly extending teeth that engage against the chain rollers of the chain. A plurality of gullets are formed between adjacent chain rollers of the chain. A drive system is coupled to the drive sprocket for rotating the drive sprocket in a forward direction to thereby drive the roller chain in a forward direction in which the cutter blades or bits remove material. Means are provided on each face of at least the drive sprocket for helping clear particulate debris tending to collect beneath, in front of and in back of each chain roller.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
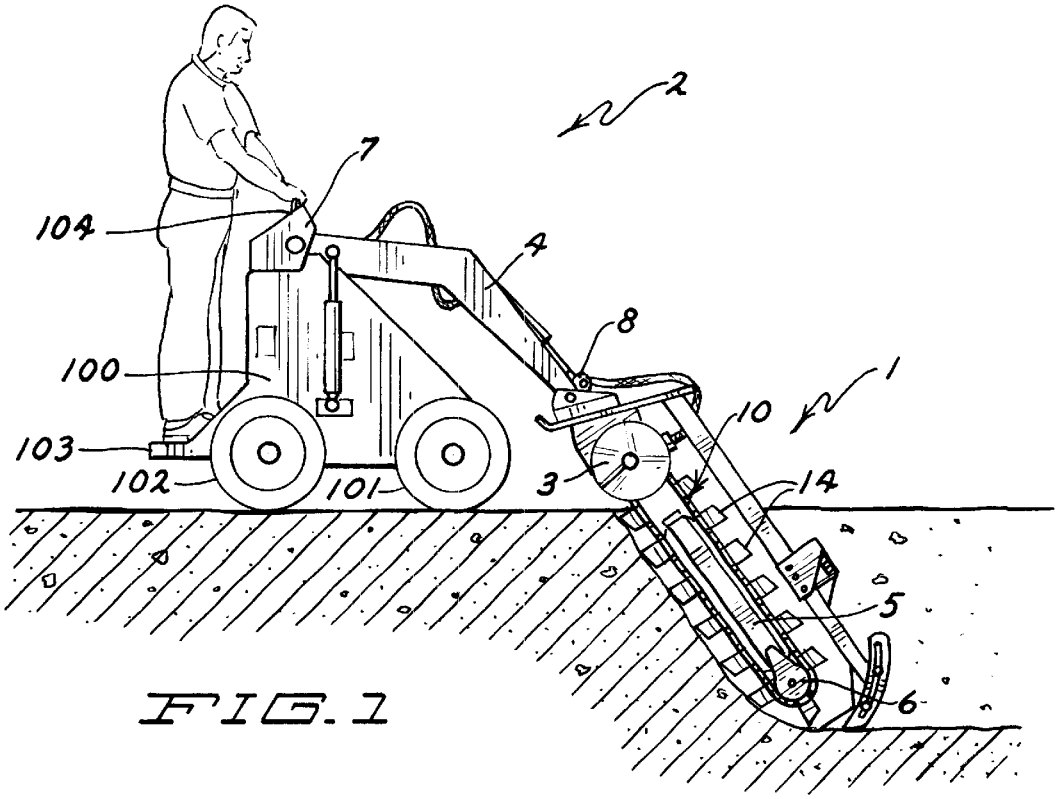
FIG. 1 is a side elevational view of a trencher which utilizes a roller chain to dig a trench with such roller chain being entrained around spaced sprockets including around at least one sprocket according to this invention, the trencher being shown in FIG. 1 in operation in the act of digging a trench.

FIG. 1 shows a trencher 2 in operation. Trencher 2 comprises a trencher attachment 1 carried on a set of lift arms 4, only one lift arm 4 being shown in FIG. 1 with the other lift arm 4 being hidden in FIG. 1. In the preferred embodiment, lift arms 4 form part of a compact utility loader 100. Compact utility loader 100 is capable of releasably coupling various attachments, such as trencher attachment 1, to the lower ends of lift arms 4 utilizing known quick attachment systems. When a trencher attachment 1 is attached to lift arms 4 of compact utility loader 100, the overall combination is referred to as a trencher 2. Obviously, trencher 2 could also be a dedicated, single purpose machine in which trencher attachment 1 is normally non-removably attached to lift arms 4.

Compact utility loader 100 as shown herein is comprised of a frame supported by front wheels 101 and rear wheels 102. An engine or motor (not shown) is carried on the loader frame to provide power. Compact utility loader 100 may also include a platform 103 on which the operator stands to operate loader 100. Alternatively, platform 103 could be removed and the operator could simply walk behind loader 100. The operation of lift arms 4 and the wheels 101 and 102 are controlled by operator controls 104. Loader 100 may be the type which is manufactured and sold by The Toro Company, the assignee of this invention, under the Dingo brand name.

As shown in FIG. 1, trencher attachment 1 comprises a frame or chain bar 5 that guides a roller chain 10. Roller chain 10 digs a trench by removing dirt and similar material from the ground as chain 10 is driven. Chain 10 includes a plurality of digging teeth 14 which are carried on chain 10 at spaced locations. Trencher attachment 1 can be positioned against or in the ground by pivoting lift arms 4 about a first pivot point 7 on loader 100 and also by pivoting trencher attachment 1 about a second pivot point 8 on the lower ends of lift arms 4.

Chain bar 5 includes a drive sprocket 3 at one end of bar 5 and an idler sprocket 6 located at the opposite end of bar 5. Drive sprocket 3 is connected to and driven by a suitable drive system, such as a hydraulic motor (not shown), that is powered by the engine of loader 100. The drive system rotates drive sprocket 3, which in turn engages and drives chain 10 in an endless path around sprockets 3 and 6. If desired, additional idler sprockets may be used between drive sprocket 3 and the first idler sprocket 6.

In operation, the operator positions chain bar 5 where the trench is to be located by means of the first and second pivot joints 7, 8 as is known in the art of trenching operations. Drive sprocket 3 is then powered, and chain 10 travels along chain bar 5, around idler sprocket 6, and back along chain bar 5 to drive sprocket 3 again. When the moving chain contacts the ground, dirt and other material are removed and the trench is dug.

Figure 2:
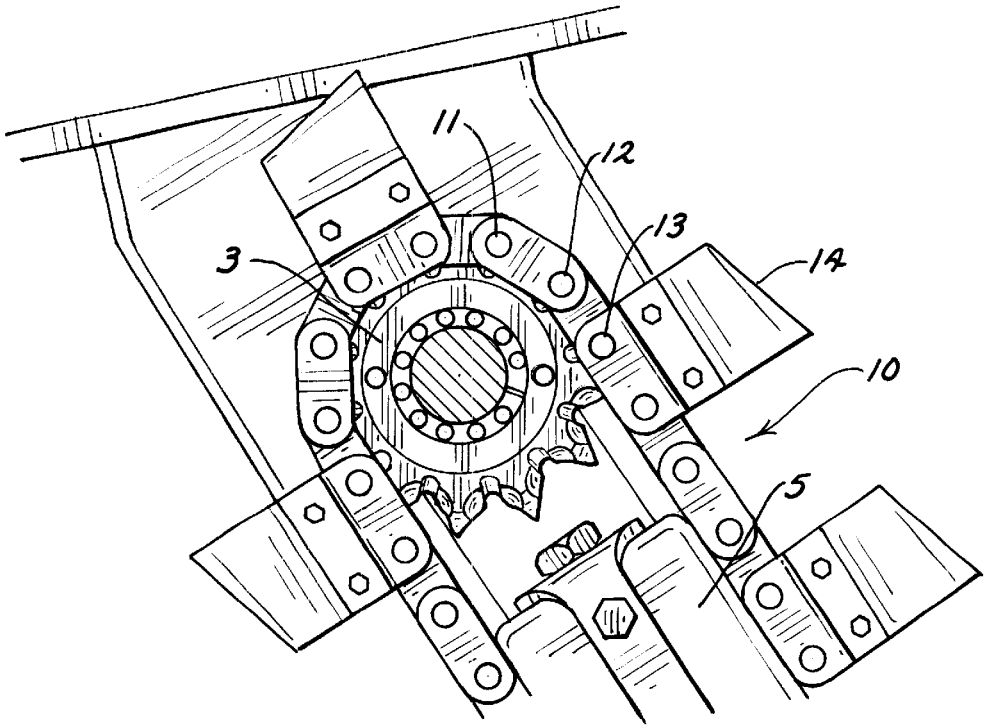
FIG. 2 is a partial side elevational view of the trencher shown in FIG. 1, particularly illustrating a sprocket according to this invention used as the drive sprocket for the roller chain that digs the trench and a portion of the roller chain including various cutting blades or bits attached to the chain links.

This invention relates to an improved sprocket for use with roller chain 10. FIG. 2 shows a more detailed view of a drive sprocket 3 according to this invention as it engages chain 10. Examples of representative chain rollers are located along chain 10. They are used to engage chain 10 with the teeth of drive sprocket 3. Representative chain rollers are indicated in the Figures as a first representative chain roller 11, a second representative chain roller 12 and a third representative chain roller 13.

Figure 3:
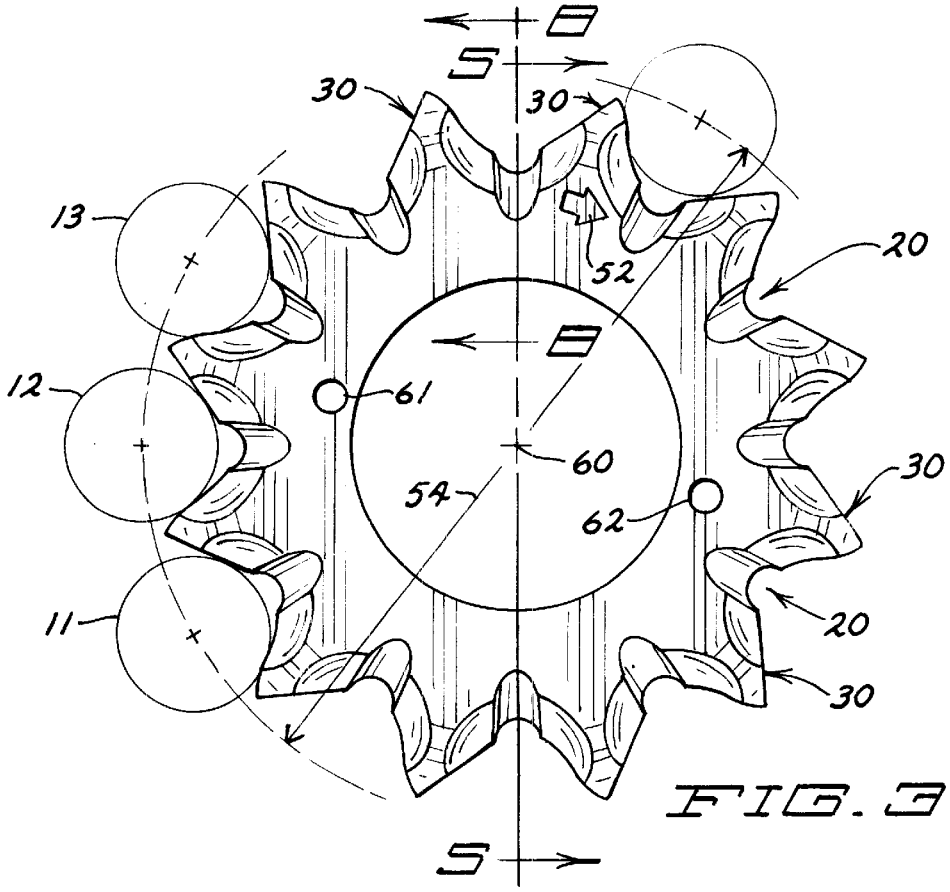
FIG. 3 is a side elevational view of a preferred form of the sprocket according to this invention.

FIG. 3 shows drive sprocket 3 disconnected from chain 10 in more detail. In the preferred embodiment, the sprocket of this invention is used as the drive sprocket for chain 10, i.e. as that sprocket which is driven by the drive system and which transmits the driving force to chain 10. However, the same sprocket as is shown for drive sprocket 3 could also be applied to idler sprocket 6 as well or any other idlers sprockets that engage chain 10. Drive sprocket 3 rotates about a central axis 60, and is mounted to a drive hub (not shown) of trencher attachment 1 by bolting through mounting holes 61 and 62.

Drive sprocket 3 contains a plurality of identical teeth 30 spaced around the circumference thereof. A gullet 20 is the space between any two adjacent teeth 30. Sprocket 3 has a plurality of identical gullets 20 around the circumference thereof. Sprocket 3 will be described herein by describing a single gullet 20 and the driving and trailing flanks of the two teeth 30 between which this gullet 20 lies. The same description applies to all the other gullets 20 and the other teeth 30 on sprocket 3.

Figure 6:
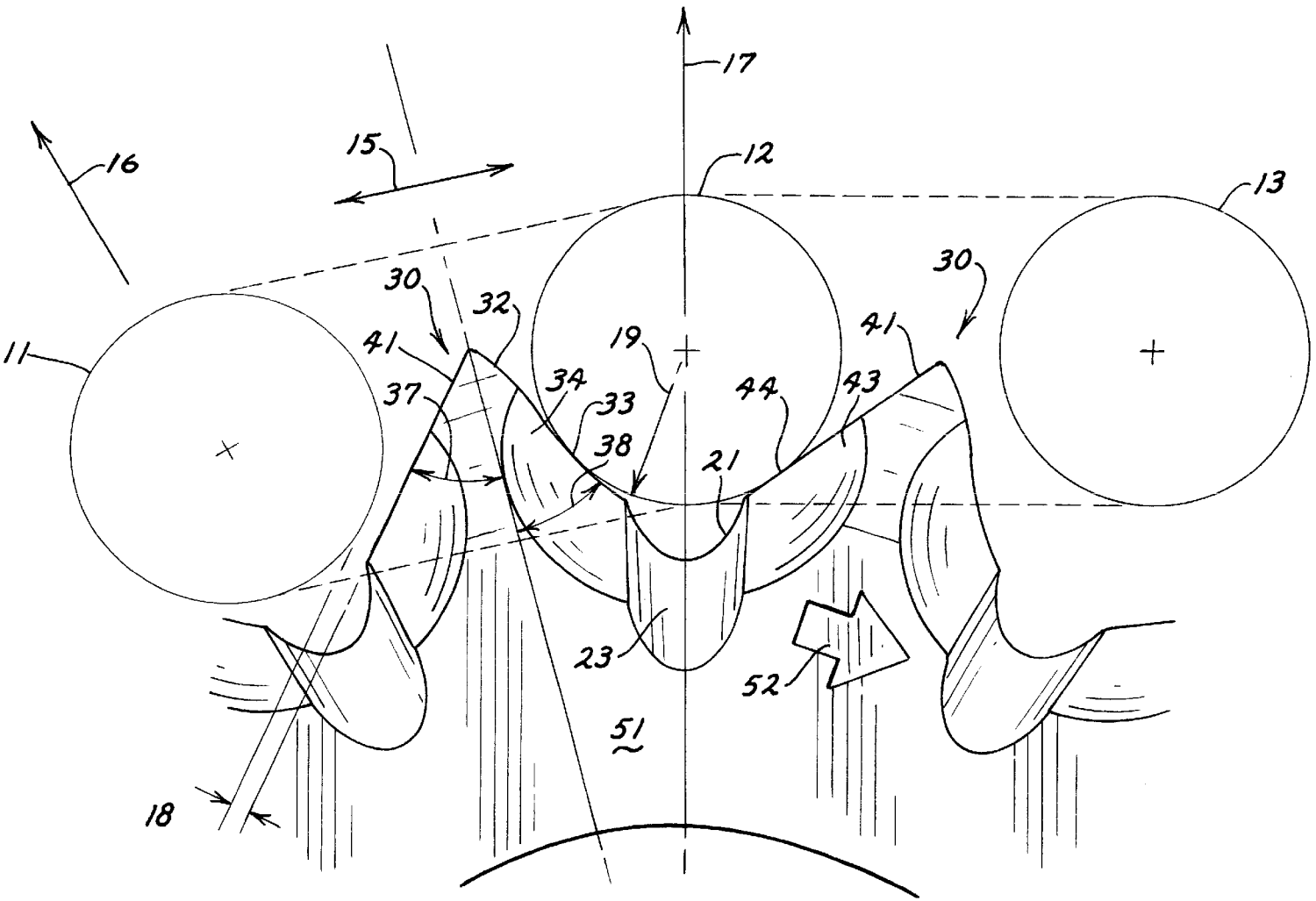
FIG. 6 is an enlarged side elevational view of two adjacent sprocket teeth of the sprocket shown in FIG. 3, particularly illustrating the sprocket teeth engaging adjacent chain rollers of a roller chain.

Referring to FIG. 3, the pitch diameter of drive sprocket 3 is indicated at 54. This is a term that is common in the industry and is defined as follows. When a chain roller 11, 12 or 13 meshes with the teeth of drive sprocket 3, there is a location where such chain roller is at its closest point to the central axis 60. In this location, the chain roller is said to be in fully engaged contact with drive sprocket 3. This fully engaged contact is illustrated in FIG. 6 with respect to chain roller 12. Chain roller 12, having a center denoted by x and a chain roller radius 19, is shown in fully engaged contact with adjacent teeth 30 when it rests on a first tangent point 33 on the leading flank of one tooth 30 and on a second tangent point 44 on the trailing flank of an adjacent tooth 30.

As shown in FIG. 3, when chain rollers 11, 12, 13 are each in fully engaged contact against drive sprocket 3, the centers x of these chain rollers all lie on an arc of a circle. The diameter of the circle that intersects the centers of the chain rollers in fully engaged contact with drive sprocket 3 is termed the pitch diameter. As noted earlier, the pitch diameter is indicated by reference numeral 54 in FIG. 3.

Figure 4:
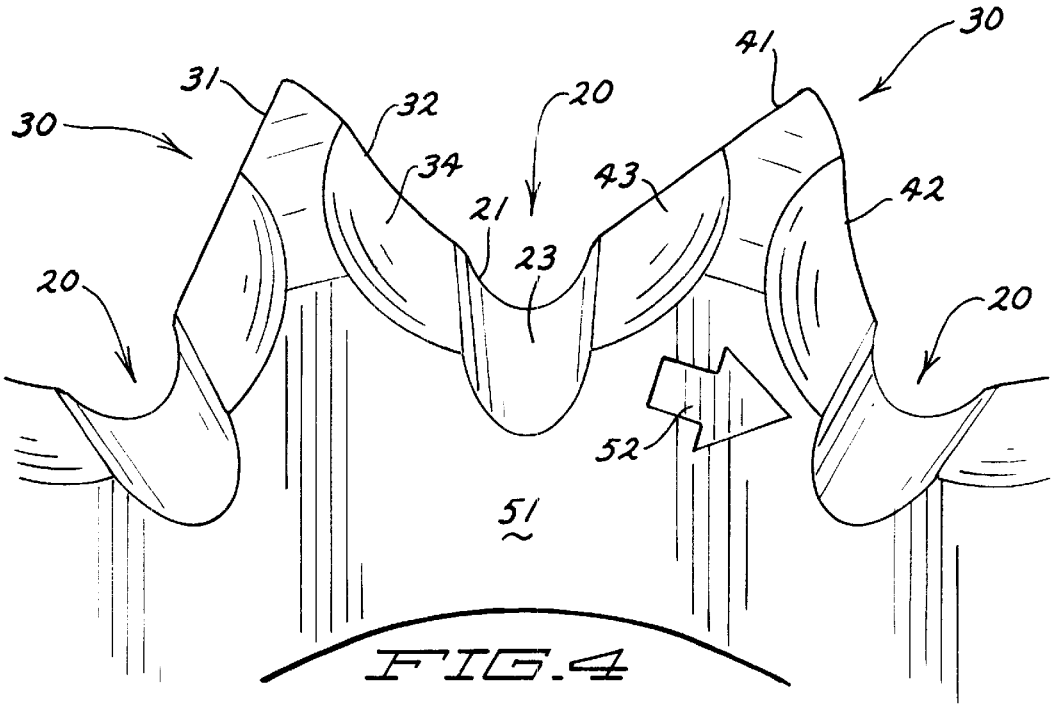
FIG. 4 is a side elevational view of two adjacent sprocket teeth of the sprocket shown in FIG. 3.
Figure 5:
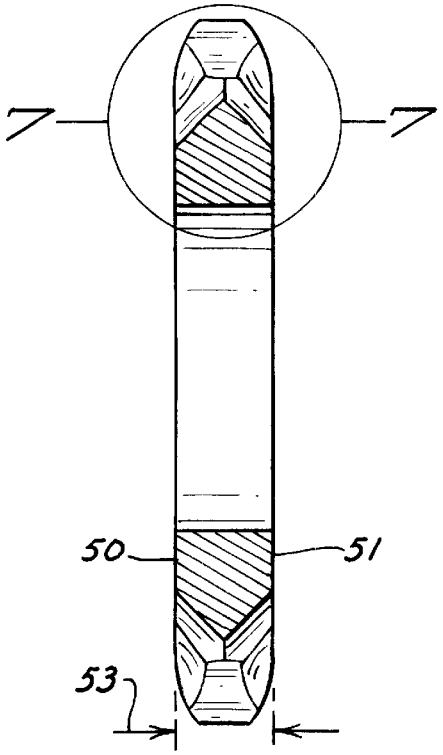
FIG. 5 is a sectional view of the sprocket shown in FIG. 3, taken along lines 5—5 of FIG. 3.
Figure 8:
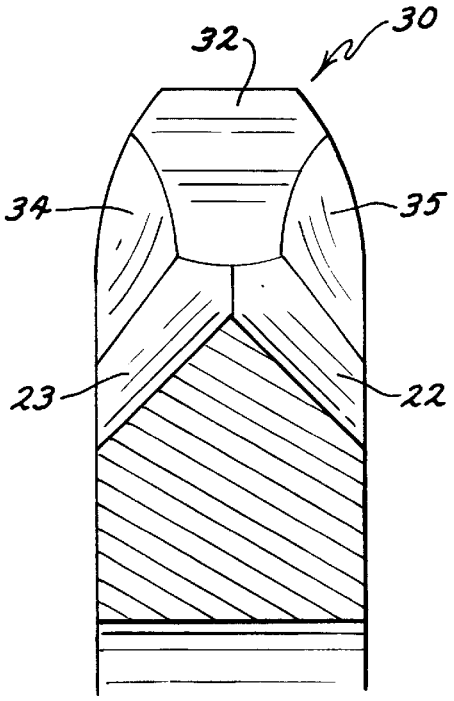
FIG. 8 is an enlarged sectional view of that portion of the sprocket shown in FIG. 5 taken along lines 8—8 of FIG. 3, particularly illustrating a section through the gullet between adjacent two sprocket teeth to illustrate the leading flank of a second sprocket tooth.

Referring now to FIGS. 3–7, drive sprocket 3 according to this invention has a first face 50 and a second face 51, which define a full thickness 53 of the sprocket 3 as shown in FIG. 5. Drive sprocket 3 comprises several cut-aways or reliefs, described in more detail below, to allow the escape of dirt or other particulate material that could potentially become entrained beneath or in front of or behind a chain roller during sprocket operation.

FIG. 4 shows a gullet 20 between two adjacent teeth 30 of drive sprocket 3. When a chain roller is received within gullet 20 in fully engaged contact with adjacent teeth of the sprocket, gullet 20 includes a gap 21 and two angled, trough-shaped cut-aways 22 and 23. Both gap 21 and cut-always 22 and 23 lie generally along a radial line extending between sprocket center 60 and the center x of chain roller 12. Both gap 21 and cut-aways 22 and 23 lie radially inwardly of chain roller 12 along the previously mentioned radial line. Gap 21 extends through the full thickness 53 of sprocket 3 while cut-aways 22 and 23 do not each extend through the full thickness 53 of sprocket 3.

Figure 7:
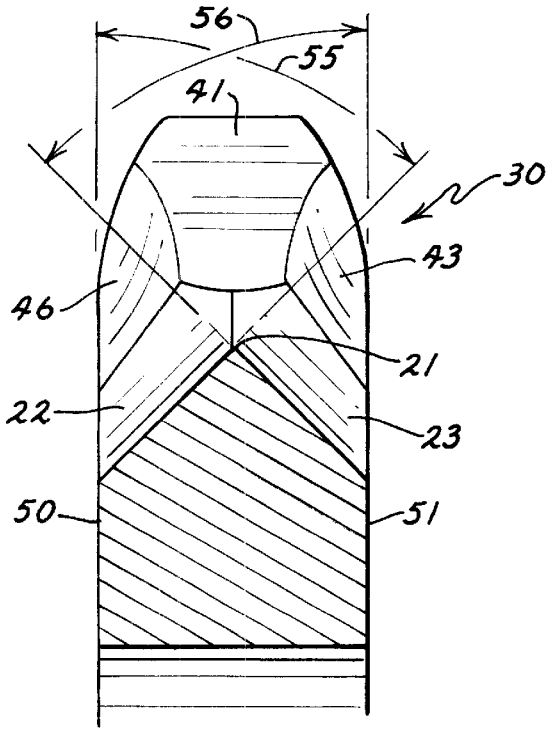
FIG. 7 is an enlarged sectional view of that portion of the sprocket shown in FIG. 5 encompassed within the circle 7, particularly illustrating a section through the gullet between two adjacent sprocket teeth to illustrate the trailing flank of a first sprocket tooth.

Cut-aways 22 and 23 are also shown in sectional view in FIGS. 5 and 7. A first angled cut-away 22 directs entrained debris towards the first sprocket face 50, while a second angled cut-away 23 directs entrained debris towards the second sprocket face 51. Gap 21 at the bottom of gullet 20, as shown in FIGS. 3 and 4 also facilitates the escape of entrained material that is trapped directly beneath a chain roller. While gap 21 has been shown herein as having a generally semi-circular form, gaps 21 having other shapes could also be used. The purpose of gap 21 is to have a space which lies immediately radially inwardly of a chain roller when the chain roller 12 is in fully engaged contact with gullet 20 rather than having this chain roller engage against the bottom of gullet 20.

As shown in FIG. 6, particulate debris is allowed extra space beneath the second representative chain roller 12 by the incorporation of gap 21 into the design of gullet 20. Gap 21 can fill with dirt or other debris and the pitch diameter 54 (as shown in FIG. 3) of the sprocket remains unaffected. If gap 21 of the invention was not included, any material that was entrained under chain roller 12 would immediately tend to force the roller radially outwards along direction 17 causing an increase in pitch diameter 54, thus putting more stress on chain 10 and increasing the likelihood of binding.

The angled, trough-shaped cut-aways 22 and 23 also facilitate the escape of entrained material that is trapped under chain roller 12. The angling of the cut-aways 22 and 23 helps such material to escape. Pressure is exerted on the material from the second representative chain roller 12 and this pressure is directed inwardly towards the sprocket axis of rotation 60. Angling the cut-aways 22 and 23 outwardly towards the sprocket faces 50 and 51 uses the inward pressure to redirect material towards the faces 30 and 51 of sprocket 3. If the angled cut-aways 22 and 23 were not present, the pressure exerted by the second representative chain roller 12 would only tend to compress the entrained material and the design would not be as conducive to the removal of material. A first angle 55 for the first angled cut-away 22 and a second angle 56 for the second angled cut-away 23 are shown in FIG. 7. In the preferred embodiment, the first and second angles 55 and 56 are both approximately 45°.

In the preferred embodiment, the angled cut-aways 22 and 23 are used in conjunction with a gap 21 to facilitate removal of material that may build up radially inwardly of the chain roller, i.e. between the chain roller 10 and the bottom of gullet 20. The angled cut-aways 22 and 23 and gap 21 are separate features that are combined for optimum effect in the preferred embodiment. However, gap 21 and cut-aways 22 and 23 could be used separately from one another.

Each cut-away 22 and 23 preferably extends through approximately one half of the full thickness 53 of sprocket 3 with the upper edges of cut-aways 22 and 23 meeting along a very thin line or ridge that forms the lowermost surface of gap 21. See FIG. 7. However, if desired, the cut-aways 22 and 23 could be cut through less than one-half of the full thickness 53 of sprocket 3 so that their upper edges would not meet at a line as they do in FIG. 7. In this event, the lowermost surface of gap 21 would have some thickness to it, rather than simply being a line as in the preferred embodiment. However, gap 21 would still preferably exist to form a space cut through the full thickness 53 of sprocket 3 lying between the bottom of chain roller 12 and cut-aways 22 and 23.

As shown in FIG. 4, drive sprocket 3 preferably also includes scallop shaped cut-aways on the faces 50 and 51 of sprocket 3 on teeth 30. For example, referring to face 51 of sprocket 4 as shown in FIG. 4, a first scallop shaped, cut-away 34 is provided on tooth 30 and a second scallop shaped cut-away 43 is provided on the adjacent tooth 30. These scallop shaped cut-aways 34 and 43 are generally symmetrical to each other, and angle outwardly towards face 51. First scallop shaped cut-away 34 lies in back of the radial line extending between sprocket center 60 and the center x of chain roller 12 while second cut-away 43 lies in front of this radial line, with "front" and "back" referring to the direction of normal forward rotation of sprocket 3 as indicated by arrow 52 provided on sprocket 3. Thus, when chain roller 12 is received within gullet 20 formed between teeth 30, second cut-away 43 lies adjacent the front side of chain roller 12 and first cut-away 34 lies adjacent the back side of chain roller 12.

Teeth 30 have a similar set of scallop shaped cut-aways located on the opposite face 50 of sprocket 30. For example, another cut-away 35 on the other side of tooth 30 corresponds to first cut-away 34. Another cut-away 46 on the other side of tooth 40 corresponds to second cut-away 43. The opposed cut-aways on each tooth, namely cut-aways 34 and 35 on tooth 30 and cut-aways 43 and 46 on tooth 40, are not cut through the full thickness 53 of sprocket 3. Instead they are only cut partially through the full thickness so that the leading and trailing flanks of each tooth are wide enough to engage against and drive the chain rollers.

The scallop shaped cut-aways 43, 46 and 34, 35, respectively, allow entrained material to escape from the front and back sides of chain roller 12. Because particulate debris may become entrained in front and behind roller 12 as well as beneath roller 12, the scallop shaped cut-aways are an improved addition to drive sprocket 3.

In addition to the various gaps and cut-aways disclosed thus far, drive sprocket 3 of this invention discloses a novel shape for the leading and trailing flanks of the sprocket teeth. Referring to FIG. 6, a first tooth 30 of sprocket 3 comprises a leading flank 32 that forms the rear side of gullet 20 taken with respect to the normal forward direction of rotation of sprocket 3. Leading flank 32 is arcuate in shape as defined in ANSI spec. B29.1-1963, R1972. This industry standard arcuate shape is used to effectively engage against the rear side of chain roller 12 to push chain roller 12, and hence chain 10, forwardly. In operation, sprocket 3 rotates in a forward cutting direction 52 and when so operating the cutting or digging teeth 14 on chain 10 are effective for cutting or digging the trench. The leading flank 32 transmits driving force to the adjacent roller 12 during forward cutting motion.

Each tooth 30 also comprises a trailing flank 41 on the side of tooth 30 opposite from leading flank 31. Trailing flank 41 forms the front side of gullet 20 taken with respect to the normal forward direction of rotation of sprocket. Trailing flank 41 does not transmit force to roller 12 during forward cutting motion.

The Applicant has discovered that even a relatively small build up of dirt or debris between trailing flank 41 causes a relatively disproportional increase in the pitch diameter due to the angle of trailing flank. The Applicant has also further discovered that while leading flank 32 of the sprocket tooth has the same angle as the trailing flank 41 in a standard sprocket having a symmetrical tooth form, debris build up on leading flank 32 is not as much of a problem since leading flank 32 engages chain roller more firmly than does trailing flank 41. Accordingly, the Applicant has found that a gap 18, to be described in more detail hereafter, often occurs between trailing flank 41 and the adjacent chain roller into which debris may more easily enter and build up with no such gap 18 occurring between leading flank 32 and the chain roller.

As a result of this discovery, the Applicant realized that an asymmetrical tooth form could be advantageous. Thus, in the preferred embodiment of this invention, trailing flank 41 is cut asymmetrically to leading flank 32. By way of illustration, looking at FIG. 6, the leading flank angle formed between leading flank 32 and a radial line extending from the sprocket center 60 through the apex of leading flank 32 is indicated at 38. The trailing flank angle formed between trailing flank 41 and a radial line extending from the sprocket center 60 through the apex of trailing flank 41 is similarly indicated at 37. As can be clearly seen in FIG. 6, trailing flank angle 37 is larger than leading flank angle 38. Thus, preferably, trailing flank 41 is flatter or is less steeply inclined relative to a chain roller in engagement with such flank 41 than is true of leading flank 32 when it engages a chain roller. The Applicant has found that this can help reduce stress in chain 10 and sprocket 3 for the reasons indicated hereafter.

As further indicated in FIG. 6, trailing flank 41 is cut on a flat plane instead of having the arcuate shape of leading flank 32. Preferably, the trailing flank angle 37 is approximately 39°. In measuring leading flank angle 38, although leading flank 32 is cut in an arcuate manner per ANSI spec. B29.1-1963, R1972, an average leading flank angle 38 can be determined by curve fitting a line through the profile of leading flank 32 as indicated by the dotted line in FIG. 6. A method such as linear regression would also be appropriate to determine the line used in measuring the leading flank angle 38. As noted earlier, trailing flank angle 37 is preferably approximately 39° while leading flank angle 38 is smaller than angle 37.

During operation of trencher 2, each link of chain 10 is under a tensile stress as indicated by arrows 15 in FIG. 6. The distance between the second chain roller 12 and the first chain roller 11 tends to increase as stress increases. As chain 10 stretches during forward cutting, trailing flank 41 may not contact the first representative chain roller 11 at all. In this case, a gap 18 may easily develop between the first chain roller 11 and trailing flank 41 where dirt may become more easily entrained. As dirt builds up in gap 18 between the first roller 11 and trailing flank 41, the first roller 11 is forced to move outwards radially along direction 16. The effective pitch diameter 54 of the sprocket as shown in FIG. 5 is thus increased, which adds stress to chain and is undesirable as noted earlier.

Figure 9A:
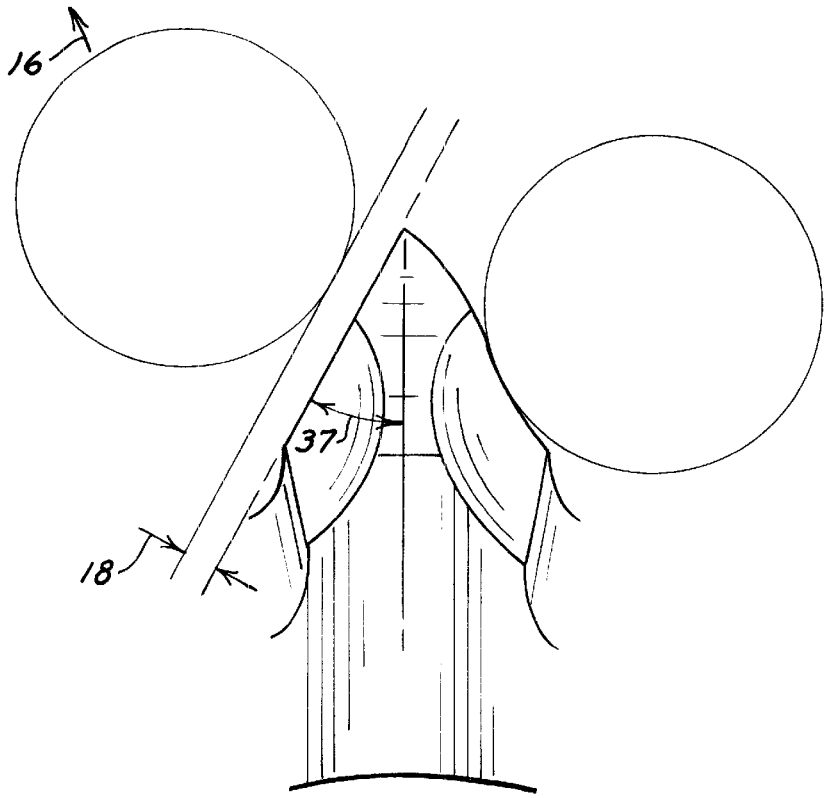
FIG. 9*a* shows a side elevational view of a sprocket tooth with a trailing flank cut at first angle.
Figure 9B:
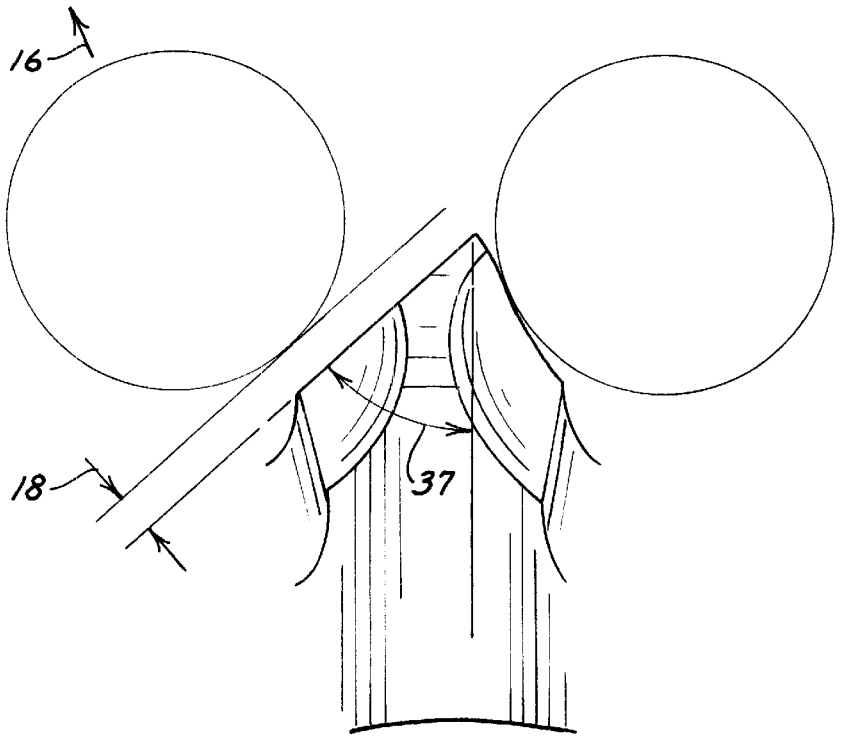
FIG. 9*b* shows a side elevational view of a sprocket tooth with a trailing flank cut at a second angle.

Trailing flank 41 is more susceptible to a build up of dirt than leading flank 32 because of the potential gap 18 into which dirt may build. A similar gap 18 is not likely to occur between leading flank 32 and the chain roller. Thus, trailing flank 41 is cut asymmetrically to leading flank 32 to address the dirt build up issue. Any entrained material that builds up on trailing flank 41 in gap 18 creates an outward displacement of the first chain roller 11 along direction 16, thereby increasing the pitch diameter 54. As shown in FIGS. 9*a* and 9*b*, as trailing flank angle 37 is increased, the amount of outward displacement in the direction 16 is decreased for a given gap size 18.

FIG. 9*a* shows a small angle 37 and a large outward displacement in the direction 16. Conversely FIG. 9*b* shows an angle 37 that is larger than the angle 37 shown in FIG. 9*a*. The outward displacement shown in FIG. 9*b* in the direction 16 is consequently smaller than the outward displacement shown in FIG. 9*a*. Thus, the Applicant has found that an increased angle 37 of trailing flank 41 therefore minimizes increases in pitch diameter 54, which in turn lowers the stress on chain 10 and sprocket 3 and increases their life.

Trailing flank angle 37 can, however, be increased too much, i.e. trailing flank 41 can be made too flat. As the angle 37 increases, there is less material remaining to form the back supporting structure for leading flank 32. Leading flank 32 needs substantial material to withstand the forces of driving chain 10 in the forward cutting direction 52. Also, despite the novel additions of the invention, in operation, the pitch diameter 54 may still increase enough to cause chain 10 to bind. In this event, it will be necessary for the operator to run chain 10 in the reverse direction to clear any dirt that has built up under the chain rollers. If trailing flank 41 is cut at too large an angle, chain 10 will slip over the teeth when drive sprocket 3 is operated in reverse.

When the trailing flank angle 37 is cut at approximately 39 degrees, the tendency for chain 10 to bind due to an increase in the pitch diameter 54 is minimized. However, this trailing flank angle 37 still provides the ability to run drive sprocket 3 in reverse if chain 10 should bind. In operation in reverse, trailing flank 41 becomes the leading flank and leading flank 32 becomes the trailing flank.

Preferably, a single drive sprocket 3 would have all the features noted herein, i.e. the asymmetrical tooth form disclosed by the different leading and trailing flank angles 38 and 37, respectively, as well as the gullet features comprising gap 21, cut-aways 22 and 23, and cut-aways 34, 35, 43 and 46. However, the asymmetrical tooth form could be used in a sprocket regardless of whether gap 21 and the various cut-aways are present. Gap 21 and cut-aways 22 and 23 are usable independently of the other cut-aways 34, 35, 43 and 46 on the sides of the teeth. Gap 21 is usable independently of any of the cut-aways.

While sprocket 3 has been shown for use in a trencher 2 for digging a trench, it is also useful for roller chains in cutting applications, such as in chainsaws, or other digging applications, such as in mining machines. All of these applications involve the removal of material. Accordingly, chainsaws, mining machines, and trenchers are all examples of material removal implements.

While the apexes of leading flank 32 and trailing flank 41 generally overlie one another so that the tip of each tooth 30 is formed as a line or ridge, the apexes could be separated from one another so that a flat land is provided on the tip of the tooth between the apexes.

Various modifications of this invention will be apparent to those skilled in the art. Thus, the scope of this invention is to be limited only by the appended claims.

We claim:

1. A material removal implement, which comprises:

(a) a roller chain having a plurality of chain rollers, the roller chain carrying a plurality of cutter blades or bits that remove material as the roller chain is driven;

(b) a drive sprocket and at least one idler member around which the roller chain is entrained, wherein the drive sprocket has a plurality of radially outwardly extending teeth that engage against the chain rollers of the chain;

(c) a drive system coupled to the drive sprocket for rotating the drive sprocket in at least a forward direction to thereby drive the roller chain in a forward direction in which the cutter blades or bits remove material; and (d) wherein the drive sprocket has asymetrically shaped teeth with each tooth having a leading flank and a trailing flank taken with respect to the forward direction of rotation of the drive sprocket, wherein the drive sprocket has a plurality of gullets formed between adjacent teeth thereof with each gullet receiving a single chain roller when the chain passes around the sprocket with each single chain roller simultaneously contacting a leading flank of one tooth and a trailing flank of an adjacent tooth when each single chain roller is in fully engaged contact with the drive sprocket in a gullet between adjacent teeth, and wherein the trailing flank has a larger angle with respect to a radial line extending from a center of the drive sprocket through an apex of the trailing flank than the angle formed between the leading flank and a radial line extending from a center of the drive sprocket through an apex of the leading flank.

2. The implement of claim 1, wherein the drive system is also configured for rotating the drive sprocket in a reverse direction, wherein the trailing flank angle is also sized to allow the chain to be driven in the reverse direction by the drive sprocket.

3. The implement of claim 1, wherein only a single drive sprocket is provided for the roller chain.

4. The implement of claim 1, wherein the trailing flank angle is approximately 39°.

5. The implement of claim 4, wherein the trailing flank is cut as a flat surface.

6. The implement of claim 5, wherein the leading flank is cut as an arcuate surface as defined in ANSI spec. B29.1-1963, R1972.

7. A The implement of claim 1, wherein the implement is a trencher to dig a trench.

8. A material removal implement, which comprises:

(a) a roller chain having a plurality of chain rollers, the roller chain carrying a plurality of cutter blades or bits that remove material as the roller chain is driven;

(b) a drive sprocket and at least one idler member around which the roller chain is entrained, wherein the drive sprocket has a plurality of radially outwardly extending teeth that engage against the chain rollers of the chain;

(c) a drive system coupled to the drive sprocket for rotating the drive sprocket in at least a forward direction to thereby drive the roller chain in a forward direction in which the cutter blades or bits remove material; and (d) wherein the drive sprocket has asymmetrically shaped teeth with each tooth having a leading flank and a trailing flank taken with respect to the forward direction of rotation of the drive sprocket, wherein the trailing flank has a larger angle with respect to a radial line extending from a center of the drive sprocket through an apex of the trailing flank than the angle formed between the leading flank and a radial line extending from a center of the drive sprocket through an apex of the leading flank, and wherein the trailing flank is cut as a flat surface and the leading flank is cut as an arcuate surface as defined in ANSI spec. B29.1-1963, R1972.

9. A material removal implement, which comprises:

(a) a roller chain having a plurality of chain rollers, the roller chain carrying a plurality of cutter blades or bits that remove material as the roller chain is driven;

(b) a drive sprocket and at least one idler member around which the roller chain is entrained, wherein the drive sprocket has a plurality of radially outwardly extending teeth that engage against the chain rollers of the chain;

(c) a drive system coupled to the drive sprocket for rotating the drive sprocket in at least a forward direction to thereby drive the roller chain in a forward direction in which the cutter blades or bits remove material; and (d) wherein the drive sprocket has asymmetrically shaped teeth with each tooth having a leading flank and a trailing flank taken with respect to the forward direction of rotation of the drive sprocket, wherein the trailing flank has a larger angle with respect to a radial line extending from a center of the drive sprocket through an apex of the trailing flank than the angle formed between the leading flank and a radial line extending from a center of the drive sprocket through an apex of the leading flank, wherein the drive sprocket has a plurality of gullets formed between adjacent teeth thereof with each gullet receiving a single chain roller when the chain passes around the sprocket, and further including at least one cut-away on each face of the drive sprocket adjacent the gullet for promoting the discharge of particulate debris from between the gullet and the chain roller.

10. The implement of claim 9, wherein the at least one cut-away on each face of the drive sprocket includes a first cut-away that lies generally along a radial line extending between the center of the drive sprocket and a center of the chain roller when the chain roller is in fully engaged contact with the gullet, the first cut-away being cut through a portion of the full thickness of the drive sprocket and being angled towards an adjacent face of the drive sprocket to conduct particulate debris from beneath the chain roller to the adjacent face of the drive sprocket.

11. The implement of claim 10, further including a gap located at the bottom of the gullet between the chain roller and the first cut-away when the chain roller is in fully engaged contact with the gullet, the gap being cut through the full thickness of the drive sprocket.

12. The implement of claim 10, wherein the first cut-away on each face of the drive sprocket is cut through approximately one-half of the full thickness of the drive sprocket such that upper edges of the first cut-aways meet along a line that defines the bottom of the gullet.

13. The implement of claim 10, wherein the at least one cut-away on each face of the drive sprocket includes another cut-away located on each face of the drive sprocket on a tooth thereof in a position that is offset from the radial line extending between the center of the drive sprocket and a center of the chain roller when the chain roller is in fully engaged contact with the gullet.

14. The implement of claim 10, wherein the at least one cut-away on each face of the drive sprocket also includes:

(i) a second cut-away located on each face of the drive sprocket on the tooth bordering one side of the gullet in a position that is in front of the radial line extending between the center of the drive sprocket and a center of the chain roller when the chain roller is in fully engaged contact with the gullet; and (ii) a third cut-away located on each face of the drive sprocket on the tooth bordering-the other side of the gullet in a position that is in back of the radial line extending between the center of the drive sprocket and a center of the chain roller when the chain roller is in fully engaged contact with the gullet.

15. The implement of claim 14, wherein the second and third cut-aways are scallop shaped.

16. The implement of claim 14, wherein the second and third-cut-aways are only partially cut through the full thickness of the drive sprocket.

17. A material removal implement, which comprises:

(a) a roller chain having a plurality of chain rollers, the roller chain carrying a plurality of cutter blades or bits that remove material as the roller chain is driven;

(b) a drive sprocket and at least one idler member around which the roller chain is entrained, wherein the drive sprocket has a plurality of radially outwardly extending teeth that engage against the chain rollers of the chain with a plurality of gullets being formed between adjacent chain rollers of the chain;

(c) a drive system coupled to the drive sprocket for rotating the drive sprocket in a forward direction to thereby drive the roller chain in a forward direction in which the cutter blades or bits remove material; and (d) wherein at least the one drive sprocket further comprises:

(i) a gap between the bottom of the gullet and the chain roller when the chain roller is in fully engaged contact with the gullet;

(ii) a pair of first cut-aways, one first cut-away being provided on each face of the drive sprocket extending radially inwardly from the gap and laterally outwardly towards the face of the drive sprocket, the two first cut-aways collectively communicating with the gap to guide particulate debris collecting in the gap to either side of the drive sprocket; and (iii) second and third cut-aways on each face of the drive sprocket located on the teeth bordering the gullet, wherein the second cut-away lies forwardly of the first cut-away and the third cut-away lies rearwardly of the first cut-away, taken with respect to the forward direction of rotation of the drive sprocket.

18. The implement of claim 17, wherein the first cut-away is trough shaped and the second and third cut-aways are scallop shaped.

19. A sprocket for a material removal implement having a roller chain that includes a plurality of chain rollers, the roller chain carrying a plurality of cutter blades or bits that remove material as the roller chain is driven, a drive system being provided to drive the roller chain in at least a forward direction in which the cutter blades or bits remove material, which comprises:

a sprocket having a plurality of radially outwardly extending teeth that engage against the chain rollers of the chain, and wherein the sprocket has asymmetrically shaped teeth with each tooth having a leading flank and a trailing flank taken with respect to the forward direction of rotation of the sprocket, wherein the drive sprocket has a plurality of gullets formed between adjacent teeth thereof with each gullet receiving a single chain roller when the chain passes around the sprocket with each single chain roller simultaneously contacting a leading flank of one tooth and a trailing flank of an adjacent tooth when each single chain roller is in fully engaged contact with the drive sprocket in a gullet between adjacent teeth, and wherein the trailing flank has a larger angle with respect to a radial line extending from a center of the sprocket through an apex of the trailing flank than the angle formed between the leading flank and a radial line extending from a center of the sprocket through an apex of the leading flank.

20. The sprocket of claim 19, wherein the sprocket includes at least one attachment aperture for attaching the sprocket to the drive system such that the sprocket comprises a drive sprocket for the roller chain.

21. A sprocket for a material removal implement having a roller chain that includes a plurality of chain rollers with a plurality of gullets being formed between adjacent chain rollers of the chain, the roller chain carrying a plurality of cutter blades or bits that remove material as the roller chain is driven, a drive system being provided to drive the roller chain in a forward direction in which the cutter blades or bits remove material, which comprises:

a sprocket having a plurality of radially outwardly extending teeth that engage against the chain rollers of the chain when the sprocket is rotated by the drive system, and wherein the sprocket further includes:

(a) a gap between the bottom of the gullet and the chain roller when the chain roller is in fully engaged contact with the gullet;

(b) a pair of first cut-aways, one first cut-away being provided on each face of the sprocket extending radially inwardly from the gap and laterally outwardly towards the face of the sprocket, the two first cut-aways collectively communicating with the gap to guide particulate debris collecting in the gap to either side of the sprocket; and (c) second and third cut-aways on each face of the drive sprocket located on the teeth bordering the gullet, wherein the second cut-away lies forwardly of the first cut-away and the third cut-away lies rearwardly of the first cut-away, taken with respect to the forward direction of rotation of the drive sprocket.

22. The sprocket of claim 21, wherein the sprocket includes at least one attachment aperture for attaching the sprocket to the drive system such that the sprocket comprises a drive sprocket for the roller chain.

* * * * *